166-66 SR
M7219 XR 4,415,030

United States Patent [19]

Walkow et al.

[11] 4,415,030

[45] Nov. 15, 1983

[54] CASING RE-ENTRY APPARATUS FOR USE IN INCLINED OIL AND GAS BOREHOLES

[75] Inventors: Arnold M. Walkow; Eugene J. Linyaev, both of Houston, Tex.

[73] Assignee: Dresser Industries, Inc., Dallas, Tex.

[21] Appl. No.: 232,607

[22] Filed: Feb. 9, 1981

[51] Int. Cl.[3] ..... E21B 17/10; E21B 31/00; E21B 47/00

[52] U.S. Cl. ..... 166/241; 166/65 R

[58] Field of Search ..... 166/241, 250, 253, 254, 166/255, 243, 65 R, 77, 54.5, 54.6; 175/61, 4.51, 4.56, 40, 45, 50; 254/134.3 FT, 134.3 R, 134.5; 104/138 G, 138 R; 105/365; 405/174, 175, 184

[56] References Cited

U.S. PATENT DOCUMENTS

| | | | |
|---|---|---|---|
| 1,662,429 | 3/1928 | Lowy | 254/134.3 R X |
| 2,398,324 | 4/1946 | Pontecorvo | 166/253 |
| 2,612,546 | 9/1952 | Romsos | 254/134.3 FT |
| 3,022,822 | 2/1962 | McStravick et al. | 166/77 X |
| 3,603,264 | 9/1971 | Arx | 104/138 G |
| 3,817,336 | 6/1974 | Sears | 175/61 |
| 4,243,099 | 1/1981 | Rodgers, Jr. | 166/241 X |

*Primary Examiner*—Stephen J. Novosad
*Assistant Examiner*—Joseph Falk
*Attorney, Agent, or Firm*—Richard M. Byron; Patrick H. McCollum

[57] ABSTRACT

Apparatus is provided for assisting a subsurface well logging instrument, perforating tool or wireline service tool in tubing or casing re-entry in deviated boreholes. The apparatus includes a body member, composed of two conjugated halves, rotatably mounted on the well logging cable immediately above the well logging instrument. A pair of wheels are rotatably mounted to the uphole facing portion of the apparatus. These wheel members provide a lifting action upon tubing or casing contact to thereby lift the logging cable off the casing and prevent the logging instrument from engaging in jammed contact with the exposed end of the tubing or casing.

7 Claims, 6 Drawing Figures

CASING RE-ENTRY APPARATUS FOR USE IN INCLINED OIL AND GAS BOREHOLES

BACKGROUND OF THE INVENTION

This invention relates generally to apparatus for logging inclined boreholes and more specifically to apparatus which eases tubing or casing re-entry of a well logging instrument, perforating gun or the like, in deviated oil and gas boreholes.

It has become relatively common within the last few years to drill wells in search of oil and gas, and the like, with a portion of the bore deviating from the usual vertical orientation thereof. The deviation or inclination may extend over some considerable distance, sometimes returning to the usual vertical orientation. It is common in the preparation of such an inclined well to set casing or pipe in the upper section of the well, thereby extending into the deviated or inclined portion, while leaving the lower section of the well open to the earth formations.

The relatively horizontal angle of the deviated portion of the wellbore makes traversal of the borehole with a typical logging instrument or perforating gun extremely difficult. The angle will not permit the wireline conveyed instruments to be easily moved into the lower portion of the borehole. Further, when raising the logging instrument from within the borehole it is not uncommon for the wireline to drag against the lower side of the casing in deviated sections. Attempts to cause the logging instruments to traverse from the "open hole" section of the borehole into the upper tubing or casing can be thwarted because of the cablehead, which connects the logging cable to the logging instrument, coming into jammed contact with the lower end of the tubing or casing. Attempts to force the logging instrument to enter the tubing or casing by exerting pulling force on the cable can result in the cable "pulling out" or breaking off at the cablehead. When this occurs, the instrument can be lost within the borehole.

Accordingly, the present invention overcomes the deficiencies of the prior art by providing an apparatus which assists the well logging instrument in re-entry into subsurface well casing in deviated oil and gas boreholes.

SUMMARY OF THE INVENTION

The present invention provides an apparatus for assisting a subsurface well logging instrument in tubing or casing re-entry in deviated boreholes. The apparatus includes an elongated body member, formed by two conjugate halves, rotatably affixed to the well logging cable immediately above the cablehead. The well logging cable traverses a longitudinal aperture within the body member allowing for the eccentric rotation of the body member about the logging cable. A pair of wheel members are rotatably affixed to the uphole facing portion of the body member. These wheel members act to lift the wireline from contact with the well casing and provide an upward lifting to allow the well logging instrument to re-enter the casing without jamming into the exposed casing end. The body member is constructed of a metal material providing a pendulum effect to thereby maintain the wheel members in a proper orientation for tubing or casing re-entry.

Accordingly, it is a feature of the present invention to provide new and improved apparatus for assisting a well logging instrument in casing re-entry in deviated oil and gas wells.

It is stil another feature of the invention to provide new and improved apparatus which, utilizing the affects of gravity, will maintain a proper orientation for casing re-entry.

DETAILED DESCRIPTION OF THE PREFERRED EMBODIMENT

Figure 1:
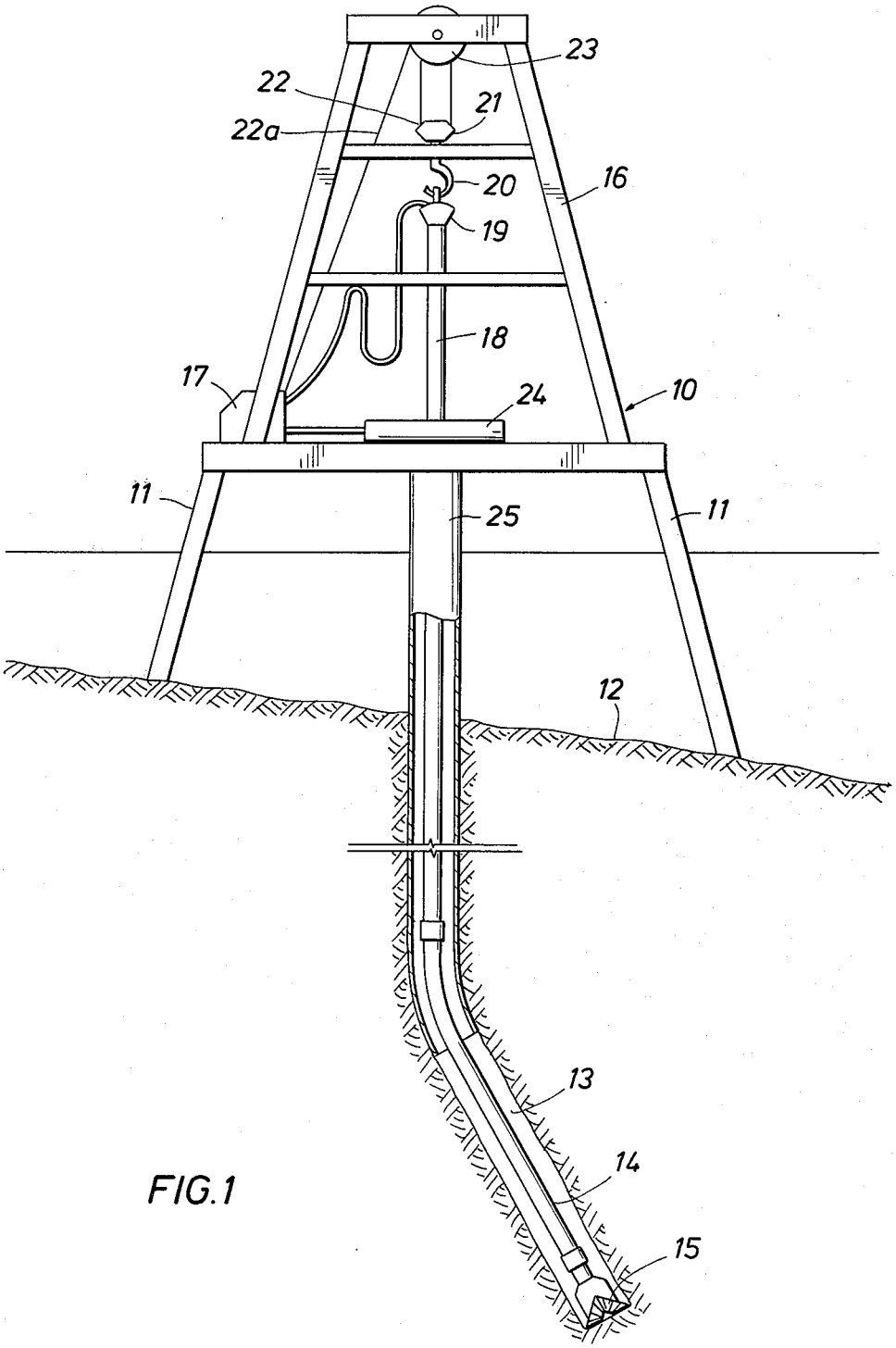
FIG. 1 is a schematic representation of a well drilling operation showing the drilling of a deviated earth borehole from an offshore platform.

Referring now to the drawings in more detail, FIG. 1 illustrates the conventional system for drilling an earth borehole having a high degree of deviation from true vertical. As is well known in the art it is common practice to drill such slanted wells from offshore platforms. A drilling platform 10 having a plurality of legs 11 anchored on the ocean floor 12 has an earth borehole 13 drilled therefrom. Within the borehole 13 is a pipestring 14 to the lower end of which is attached a drillbit 15. A surface casing 25 is placed in the upper portion of the borehole 13 and maintains the integrity of the borehole 13. A derrick 15, with conventional draw works 17, is mounted on platform 10.

The drillstring 14 comprises a number of jointed sections of pipe terminating in its upper end in a kelly 18 followed by a swivel 19, a hook 20, and a traveling block 21 suspended by a drill line 22 from crown block 23. The draw work 17 also drives a rotary table 24 which in turn transmits the drive to kelly 18. One end of line 22, namely the fast line 22A is connected to draw work 17 which contains the motor or motors for manipulating the drill string. Although not illustrated, the other end of the drill line is secured to an anchor on the platform floor, that portion of the line extending to the anchor from the crown block generally referred to as the deadline.

In the operation of the system according to FIG. 1, it is guite conventional in drilling wells from such offshore platforms to drill the initial portion of the wells substantially along the vertical line of the platform and then to angle off in the further drilling of the wells. Such wells, after angling off, will often be inclined to an angle to 60° to 70° from vertical. The upper portion of the well will normally be cased, often times with the casing extending into the deviated portion of the well.

Figure 2:
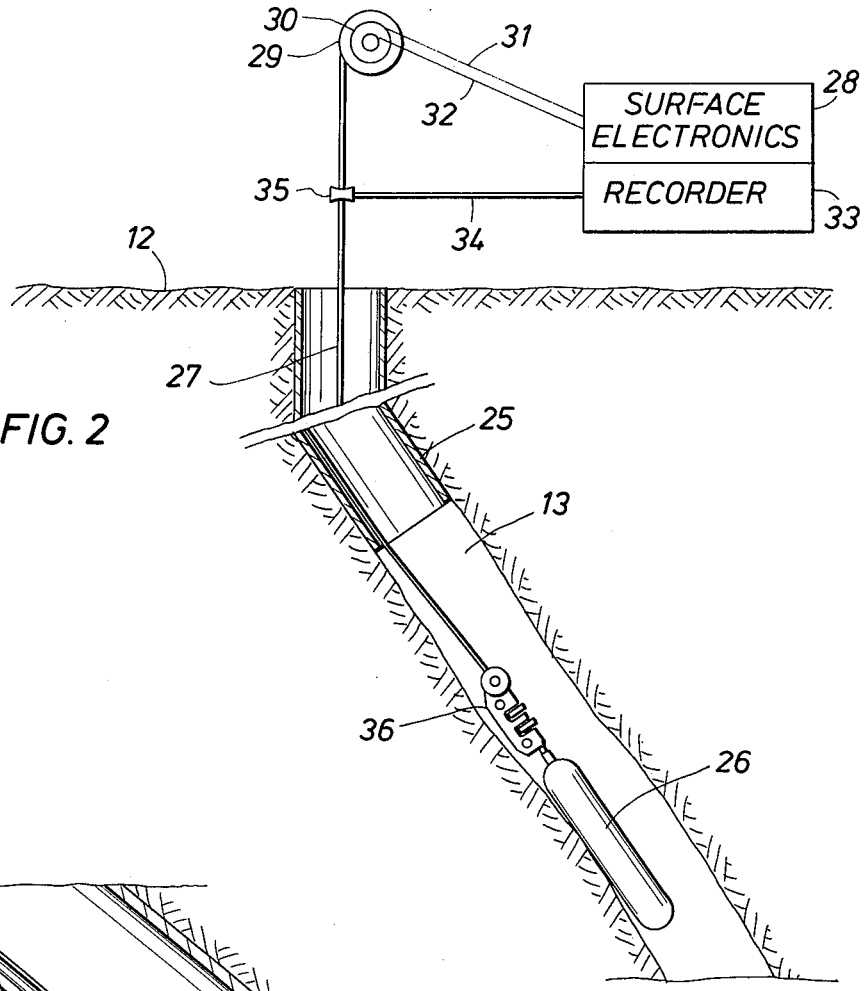
FIG. 2 is a schematic representation of the present invention where the casing re-entry apparatus is located on the wireline above the well logging instrument.

Referring now to FIG. 2, there is illustrated schematically a well logging operation conducted in accordance with the present invention in which a portion of the earth's surface 12 is shown in vertical section. A well 13, which has been drilled as illustrated in FIG. 1, penetrates the earth's surface. Disposed within the well 13 is subsurface instrument 26 of the well logging system. Subsurface instrument 26 may be of any conventional type, for example, one which is adopted to conduct an induction, electric, acoustic or any of the conventional logs known in the art or may be a perforating gun or wireline service tool. It should be appreciated that the particular type of well logging instrument forms no part of the present invention.

Cable 27 suspends instrument 26 in well 13 and contains the required conductors for electrically connecting subsurface instrument 25 with surface electronics 28. Cable 27 is wound or unwound from drum 29 in raising and lowering instrument 26. During the traversal of the well 13 signals from well logging instrument 26 are sent up cable 27. By way of slip rings and brushes 30 on drum 29, the signals are connected by conductors 31 and 32 to surface electronics 28. Recorder 33, connected to surface electronics 28, is driven through transmission 34 by measuring reel 35 over which cable 27 is drawn so that recorder 33 moves in correlation with depth as surface instrument 26 traverses well 13. Located immediately above the cablehead connecting cable 27 to subsurface instrument 26 is re-entry assembly 36, which assists logging instrument 26 in re-entering the lower extremity of well casing in deviated wells.

Figure 3A:
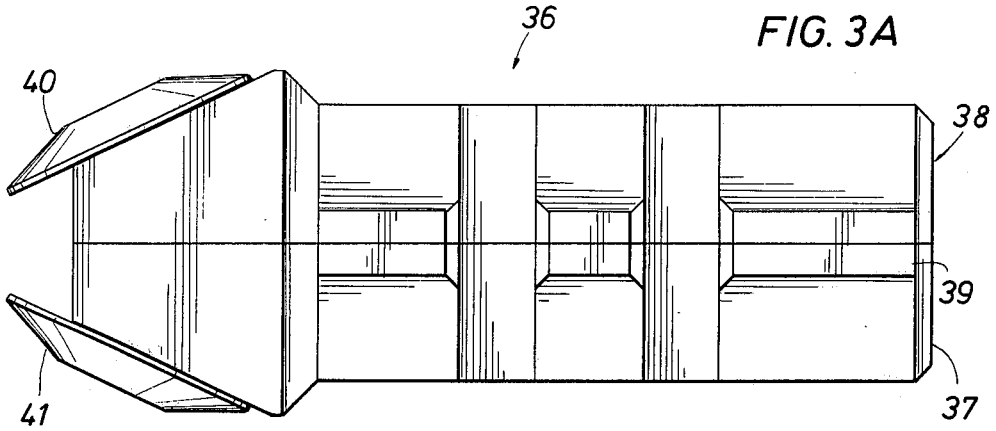
FIG. 3A is a representation of the top view of the apparatus of the present invention.

Referring now to FIG. 3A, there is illustrated in detail a top view of re-entry apparatus 36. Re-entry apparatus 36 is comprised of two conjugate body members 37 and 38. Each body member 37 and 38 is channeled so that when body members halves 37 and 38 are joined a longitudinal aperture 39 is formed therein. As illustrated in FIG. 3A, when body member halves 37 and 38 are joined together the uphole or frontal portion forms generally an isosceles trapezoidal quandrangle. A pair of wheel members 40 and 41 are rotatably affixed to the outer sides of the quandrangle formed by the end portion of body members 37 and 38. Wheel members 40 and 41 are mounted so as to partially extend beyond the end of member 36.

Figure 3B:
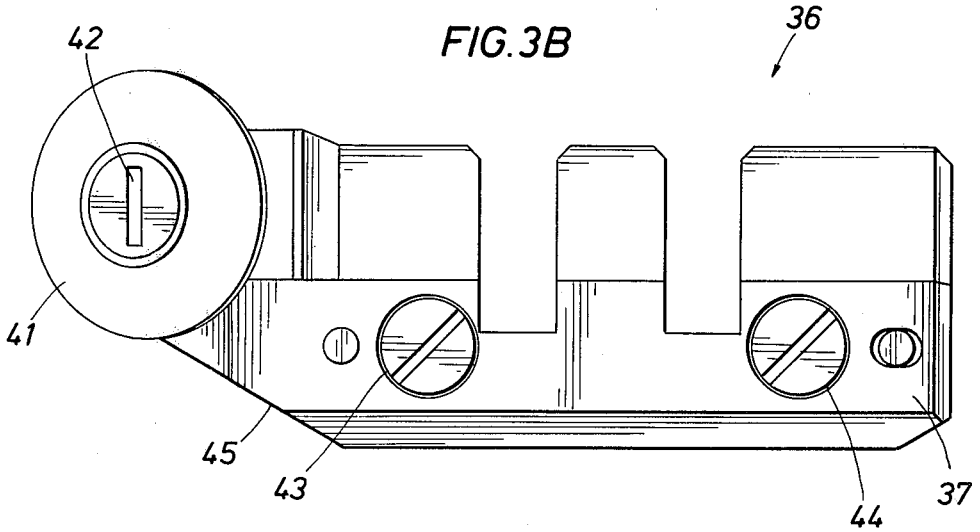
FIG. 3B is a representation of the side view of the apparatus of the present invention.

Turning now to FIG. 3B, there is illustrated a side-view of re-entry apparatus 36 showing body member 37 with wheel member 41 rotatably mounted thereon by means of a shoulder type axle screw 42. Body member 37 is retained to body member 38 to form assembly 36 by means of screws 43 and 44. Additionally, guide pins 45 and 46 provide for the proper alignment of body members 37 and 38 and further assure a true longitudinal center line of aperture 39. The lower portion of the frontal or uphole end of body member 37 and body member 38 are taper cut from front to back so as to provide a sliding surface the purpose of which will hereinafter become apparent. Wheel member 41 is of sufficient diameter to extend below the lower frontal portion of body member 37.

Figure 3C:
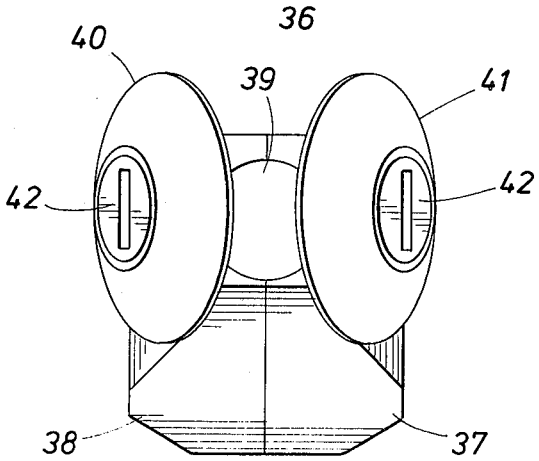
FIG. 3C is a representation of the uphole end view of the apparatus of the present invention.

Referring now to FIG. 3C, there is illustrated the uphole facing view of re-entry apparatus 36 comprised of body members 37 and 38 with wheel members 41 and 42, respectively, attached thereto. As illustrated in FIG. 3C, when body members 37 and 38 are joined together, there is formed aperture 39 through which logging cable 37 passes. The inside diameter of aperture 39 is slightly larger than the outside diameter of cable 37 so that re-entry apparatus 36 is free to rotate about cable 37. Further, aperture 39 is located above the longitudinal center of gravity line allowing for the eccentric rotation of member 36 about cable 37. Re-entry apparatus 36 is constructed of a metal material, such as steel or bronze, so that the affects of gravity will provide a pendulum effect to assure that the main body portion is maintained in a downward position relative to the well. By maintaining this orientation wheel members 40 and 41 will be kept in proper alignment for assisting in casing re-entry.

Figure 4:
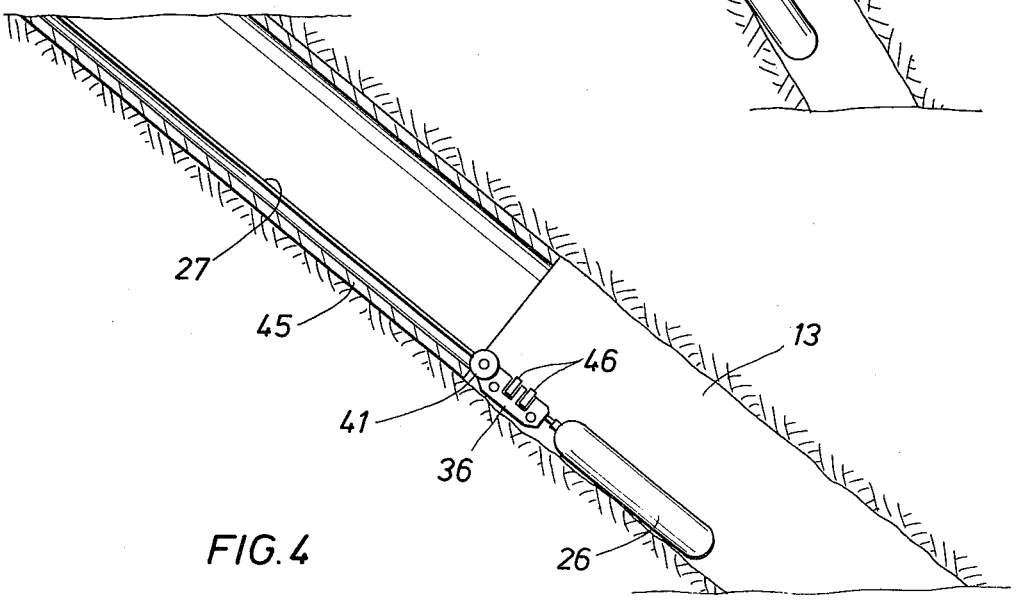
FIG. 4 is a close-up view of the cased-uncased interface of a borehole with the re-entry apparatus located on the wireline above the well logging instrument.

As hereinbefore explained it is not uncommon for casing to be set within the upper portion of a wellbore extending into the deviated portion. Turning now to FIG. 4, there is shown a close-up view of the cased-uncased interface of borehole 13. In traversing a deviated borehole it is common in a deviated section of the borehole for logging instrument 26 to drag on the lower side of borehole 13. Further, when traversing the deviated section of borehole 13 cable 27 will commonly drag along the lower side of casing 45. When attempting to re-enter casing 45 without the aid of re-entry apparatus 36 it is common for the cablehead to come into jammed contact with the exposed end of casing 45. To prevent such an occurrence, re-entry apparatus 36, as hereinbefore described, is rotatably attached on cable 27. Clamps 46 are affixed to cable 27 to prevent apparatus 36 from moving upward or downward on logging cable 27. As logging instrument 26 traverses up borehole 13, wheel members 41 and 42 will first contact the exposed end of casing 45. As wheel members 41 and 42 enter casing 45 cable 27 will be lifted from contact with casing 45. Upon further uphole movement of the logging cable, wheel members 41 and 42 will fully enter casing 45, followed by the tapered skid surface of the underside of the re-entry apparatus 36 allowing for the casing entry of the remainder of re-entry apparatus 36. When logging instrument 26 starts casing re-entry, apparatus 36 will maintain cable 27 a sufficient height off the lower side of casing 45 to assure that instrument 26 will enter casing 45 without jamming.

Thus, there has been illustrated and described herein the preferred embodiment of the present invention which provides an apparatus to facilitate casing re-entry of a well logging instrument in deviated boreholes. Those skilled in the art will recognize that obvious modifications can be made without departing from the spirit of the invention.

The embodiments of the invention in which an exclusive property or priviledge is claimed are defined as follows:

1. Apparatus for traversing a deviated borehole, comprising:

a well logging cable;

an elongated logging instrument attached to said cable; and a casing re-entry assistor mounted on said cable at a location immediately above said logging instrument, said re-entry assistor formed by two conjugate body halves with a pair of wheels rotatably mounted thereon.

2. The apparatus of claim 1 further comprising means to prevent said re-entry assistor from moving longitudinally on said cable.

3. The apparatus of claim 2 wherein said re-entry assistor is allowed to eccentrically rotate about said logging cable.

4. The apparatus of claim 3 wherein said wheels are mounted on said re-entry apparatus at an angular relation to the longitudinal axis thereof.

5. Apparatus for assisting a well logging instrument, suspended within a borehole from a cable, in casing entry in deviated boreholes, comprising:

a first body member with a first longitudinal channel therein;

a second body member with a second longitudinal channel therein;

a first wheel rotatably mounted on said first body member;

a second wheel rotatably mounted on said second body member;

means to conjugately join said first and said second body members with said first and said second channels therein aligned to form a longitudinal aperture for said cable to traverse therethrough; and clamp means for securing said joined body members from longitudinal movement on said cable while allowing free rotation thereabout.

6. The apparatus of claim 5 wherein said first and said second wheels are mounted on said first and said second body members, respectively, at an angular relation to the longitudinal axis thereof.

7. The apparatus of claim 6 wherein said longitudinal aperture is located above the center line of said joined body member to allow for eccentric rotation of said joint body members about said cable.

* * * * *